US005237313A

United States Patent [19]

Paxton et al.

[11] Patent Number: 5,237,313

[45] Date of Patent: Aug. 17, 1993

[54] METHOD FOR EDITING CHARACTER BITMAPS AT SMALL SIZES

[75] Inventors: William H. Paxton, Los Altos Hills; Stephen N. Schiller, Menlo Park, both of Calif.

[73] Assignee: Adobe Systems Incorporated, Mountain View, Calif.

[21] Appl. No.: 775,267

[22] Filed: Oct. 11, 1991

Related U.S. Application Data

[63] Continuation of Ser. No. 388,339, Aug. 1, 1989, abandoned.

[51] Int. Cl.[5] ..... Q09G 1/00

[52] U.S. Cl. ..... 340/735; 340/731

[58] Field of Search ..... 340/735, 731, 728

[56] References Cited

U.S. PATENT DOCUMENTS

| | | | |
|---|---|---|---|
| 3,614,767 | 10/1971 | Carrell | 340/735 X |
| 4,447,882 | 5/1984 | Walz | 340/731 X |
| 4,555,191 | 11/1985 | Gojo | 340/731 X |
| 4,610,026 | 9/1986 | Tabata et al. | 340/728 X |
| 4,881,069 | 11/1989 | Kameda et al. | 340/735 |

OTHER PUBLICATIONS

Bruce Mielke, "Integrated Computer Graphics", West Publishing Company, N.Y., 1991, pp. 56–64.

O. W. McThompson et al., "Ergonomic Character Font For CRT Display," IBM Technical Disclosure Bulletin, vol. 26, No. 4, Sep. 1983, p. 2120.

*Primary Examiner*—Ulysses Weldon

*Attorney, Agent, or Firm*—Roger S. Borovoy; David J. Larwood

[57] ABSTRACT

An improved method for displaying a character on a raster device at relatively low resolution by identifying regions of the character that improperly touch other regions of the character, and then modifying the display of that character to move or delete pixels which decrease legibility of the character, by (1) enumerating the pixels in an order determined by the path topology, (2) searching for sequences of pixels corresponding to a pointed feature in the character that undesirably touches other parts of the character, and (3) editing the bitmap to remove such contacts.

5 Claims, 4 Drawing Sheets

METHOD FOR EDITING CHARACTER BITMAPS AT SMALL SIZES

This application is a continuation of application Ser. No. 388,339, filed Aug. 1, 1989 is now abandoned.

FIELD OF THE INVENTION

In modern computer systems, it is often desireable to print or display characters in various sizes on paper, film or a computer screen. When the size of the character is large relative to the resolution of the display or print device, it is relatively easy to choose which picture elements or pixels should be printed or displayed in order to make a readable character. However, when the size of the character is small in relation to the resolution of the display, it is much more difficult to choose which pixels to display in order to make the character as distinct and recognizable as possible The current invention relates to an improved method of legibly displaying characters at low resolution.

BACKGROUND OF THE INVENTION

Traditionally, characters have been printed using metal type which allows very detailed rendering of a character, including subtle curves and very fine lines. In modern computer devices, characters are defined on raster devices such as video display terminals or by using a multi-pin print head. Characters can be printed on a surface or displayed on a video screen as a series of dots which are printed or turned on in order to approximate as closely as possible the ideal shape of the character. When characters are small enough relative to the resolution of the display device, choosing which pixels should be displayed to accurately represent the character becomes more complex than when the character is large. A typical video monitor can display about 72 pixels per inch. At this resolution it is difficult to display legibly most type faces smaller than about twenty pixels tall.

An ideal representation of the character is usually defined in "character space" at very high resolution as one or more areas bounded by an outline or path. A character consists of one or more continuous black areas. For instance the letter "O" consists of a single closed loop, the letter "d" consists of a loop connected to a line and the letter "i" consists essentially of a dot a short distance away from a line which may have additional details such as serifs. One way of describing a character involves defining an outline of the outer edge of each contiguous black portion of the character and then filling that outline to display the character. Since characters are usually printed in dark ink on a light background, one can describe filled areas as black but one skilled in the art will recognize that characters which are light on a dark background, commonly used in video displays, are also within the teachings of this invention. This path can be represented as a sequential series of curves and/or linear line segments called edges. If a black area has interior white areas as, for instance, in the letter "O", each interior white area can also be defined by a path consisting of a series of edges.

When tracing or displaying such a character, it is generally useful to trace the edges in a consistent direction, either clockwise or counter-clockwise. If edges of an outside path are traced in the counter-clockwise direction, then the area to the left of that edge will always be black and the area to the right will always be white. If the path is traced in the clockwise direction, the black area will be on the right of the edge. Enclosed white areas should be traced in the direction opposite to the exterior path so that the black area is on the same relative side of the edge.

When a character is displayed on a raster device, those pixels which fall within the black area of the character should be displayed, that is, they should be printed on a surface or turned on for a video display. Various methods of filling a character outline are known to those skilled in the art. At high resolution or when the character is very large, multiple pixels may fall within each black area and the character can be displayed in great detail. When the character is reduced to a small size, however, or the resolution of the device is limited, certain black areas may no longer cover multiple pixels and in fact may cover only a fraction of a pixel. Displaying small characters on a device of limited resolution has been a persistent problem in the past. This is illustrated in FIG. 1 by a character on an 6×7 matrix. In FIG. 1 the outlines of the characters "n", "s" and "e" are illustrated. The raster display can only turn on or off entire pixels as represented by the elements of the 6×7 matrix.

One prior approach to this problem is the center point fill method and the improved fill method described in the copending application entitled "Dropout-Free Center Point Fill Method For Displaying Characters" by the same inventors and filed on the same date as the present application. One problem that occurs with many fill methods is that certain character features may be found in close proximity. As the display resolution decreases the pixel fill method chosen sometimes turns on pixels that cause parts of the character bitmap to touch each other that actually should not be in contact. This introduces errors in the topology of the character that greatly reduce the legibility. For example, in FIGS. 1A, 1B and 1C the "n" closes in at the bottom instead of having an open space between the legs, and the curves of the "e" and the "s" both touch the main body of the character and change the bitmap into something like a small "8".

One object of this invention is to turn on pixels according to the outline of a character using one of the fill rules such as center point fills, and modify the display by turning off or moving pixels that cause the character to close improperly.

FIGS, 3A–3H illustrates groups of four pixels in which the start pixel and the end enumerated pixel are identical.

FIGS. 4A–4H illustrates certain configurations of groups of three pixels and the corresponding path enumeration.

FIGS. 5A–5H illustrates groups of three pixels in which the start and end enumerated pixel are identical.

FIGS. 6A–6D illustrates groups of three pixels in which the end pixel touches corner-to-corner with the start pixel.

FIGS. 7, 8 and 9A-9B illustrate tests for conflict which are part of this invention.

Figure 10:
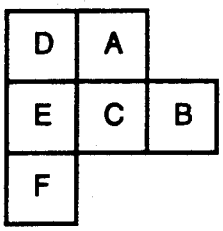

FIG. 10 illustrates resolution of a "move" or "delete" decision.

Figure 11:
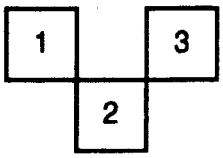

FIG. 11 illustrates an additional pixel pattern.

SUMMARY OF THE INVENTION

The present invention details a method to detect and fix certain topological errors in character bitmaps by (1) enumerating the pixels in an order determined by the path topology, (2) searching for sequences of pixels corresponding to a pointed feature in the character that touches other parts of the character bitmap, and (3) editing the bitmap to fix such incorrect contacts.

DETAILED DESCRIPTION OF THE INVENTION

The concept of describing characters by means of an outline has been explained above. The path of the outline can be traversed in either a clockwise or counter-clockwise direction, and if the path is traversed in a counter-clockwise direction, the black area of the character will be to the left of the path and the background or non-character area will be to the right of the path. The method of this invention can be used by tracing the path in either direction, but a counter-clockwise traverse will be assumed for the purpose of these examples The path is thus assumed to be oriented so that the inside of the character is on the left as you face in the direction of the path. If the character is outlined by more than one path, each such subpath is enumerated separately. Enumeration of a character outline is simply a listing of each displayed pixel which includes or is adjacent to each portion of the character path.

Enumerating the Pixels Along the Edge of the Character

The method of enumeration should preferably match the fill method that was used to turn on pixels in the first place. Assuming a center point fill method with modifications to prevent dropout (as described in the co-pending patent application referenced supra), output or include a pixel in the enumeration whenever the path crosses a horizontal or vertical midline connecting pixel centers. Within a pixel there are four midlines to consider, vertical midlines above and below the center point, and horizontal midlines left and right of the center point. For each of these four midlines there are two cases depending on the orientation of the path when it crosses the midline. Trace the path of the character outlines and do the following tests to decide which pixel to output when the path crosses one of the four midlines. The "current pixel" means the one containing the midline that has been crossed.

If the path intersects the center of the current pixel, then output the current pixel.

If the path crosses the left horizontal midline from top to bottom, or crosses the right horizontal midline from bottom to top, or crosses the top vertical midline from right to left, or crossing the bottom vertical midline from left to right, then output the current pixel.

If the path crosses the left horizontal midline from bottom to top, then output the current pixel if it is turned on in the bitmap, else output the pixel to its left.

If the path crosses the right horizontal midline from top to bottom, then output the current pixel if it is turned on in the bitmap, else output the pixel to its right.

If the path crosses the top vertical midline from left to right, then output the current pixel if it is turned on in the bitmap, else output the pixel above.

If the path crosses the top vertical midline from the right, then output the current pixel if it is turned on the bitmap, else output the pixel below.

A path section that crosses a vertical midline exactly at the boundary between two pixels is considered to be in the bottom pixel if it is oriented right to left and in the top pixel otherwise.

A path section that crosses a horizontal midline exactly at the boundary between two pixels is considered to be in the right pixel if it is oriented top to bottom and in the left pixel otherwise.

If two or more sequential crossings cause the same pixel to be output, discard all but one so that no pixel occurs immediately following itself in the enumeration. This simplifies the pattern matching in the next stage. Copy the first three pixels to the end of the enumeration for the path so that the pattern matching does not have to worry about checking patterns that "wrap around" the place where the path begins and ends. The result of the enumeration part of the method of this invention is an enumeration or list of pixels in the order by which a path traverses the pixels.

Matching

The matching process goes through the list of pixels output in the enumeration stage to identify sequences corresponding to a pointed feature in the character that touches other parts of the character bitmap. Examples of pointed features are diagrammatically shown in FIGS. 2-6. When such a contact is discovered, one or more edits are recorded for the final stage.

The patterns corresponding to pointed character features or pointed groups of pixels consist of three or four pixels arranged in a counterclockwise sequence. The sequential ordering of the pixels is indicated by the numbers inside the cells in the FIGS. 2-11. Their relative positions in the display are as shown. (Since the path is oriented with the inside of the character on the left, a series of pixels forming an outward directed point will create a counterclockwise pattern.) The four-pixel patterns (FIGS. 2, 3) have a two pixel point (two point pixels), and the three-pixel patterns (FIGS. 4, 5) have a one pixel point a point pixel. All possible matches are tested. For example, a sequence of pixels may be part of both a four-pixel pattern and a three-pixel pattern and edits may be recorded for each match.

Figure 2A:
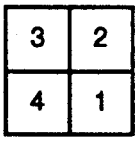
FIGS. 2A–2L illustrates certain configurations of groups of four pixels and the corresponding path enumeration.
Figure 2B:
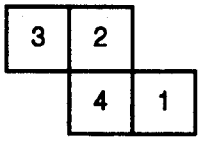
Figure 2C:
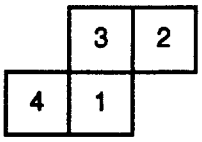
Figure 2D:
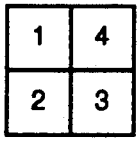
Figure 2E:
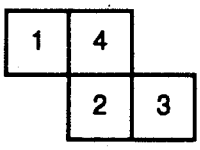
Figure 2F:
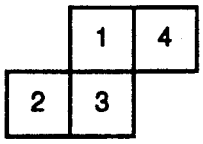
Figure 2G:
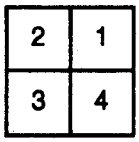
Figure 2H:
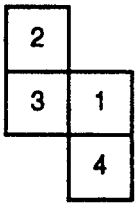
Figure 2I:
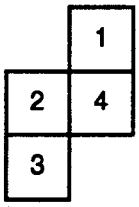
Figure 2J:
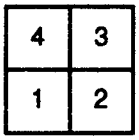
Figure 2K:
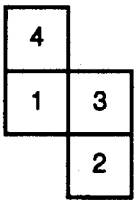
Figure 2L:
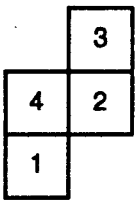
Figure 3A:
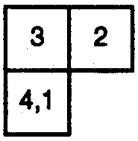
Figure 3B:
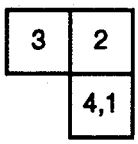
Figure 3C:
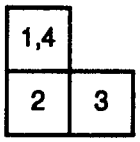
Figure 3D:
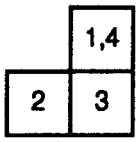
Figure 3E:
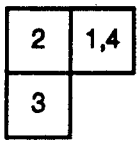
Figure 3F:
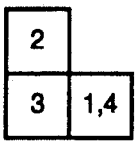
Figure 3G:
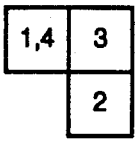
Figure 3H:
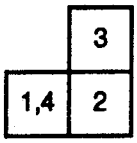
Figure 4A:
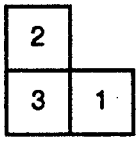
Figure 4B:
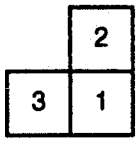
Figure 4C:
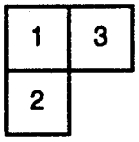
Figure 4D:
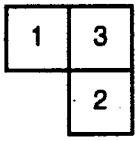
Figure 4E:
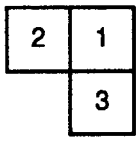
Figure 4F:
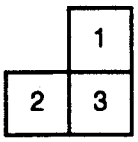
Figure 4G:
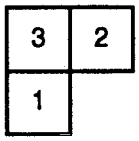
Figure 4H:
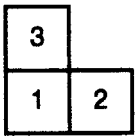
Figure 5A:
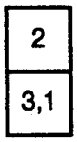
Figure 5B:
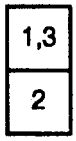
Figure 5C:
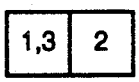
Figure 5D:
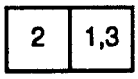
Figure 5E:
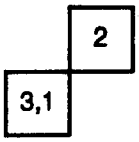
Figure 5F:
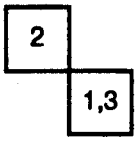
Figure 5G:
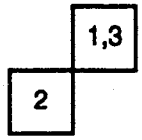
Figure 5H:
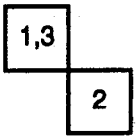
Figure 6A:
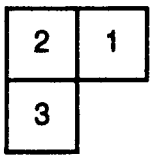
Figure 6B:
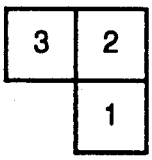
Figure 6C:
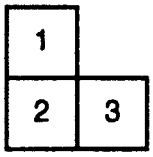
Figure 6D:
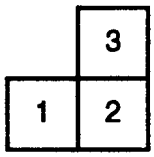
Figure 7:
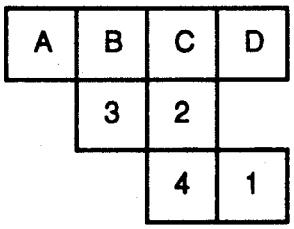
Figure 8:
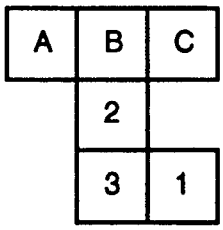

Once a point pattern has been found, the match process checks to see if any point pixels touch other pixels in the character bitmap that they should not touch. Pixels may "touch" other pixels by intersecting side-to-side (top-to-bottom is equivalent) or intersecting at a corner. In FIG. 2A, for example, pixel 1 touches pixels 2 and 4 side-to-side and touches pixel 3 corner-to-corner. In the case of a four-pixel pattern as in FIGS. 2A-2L or 3A-3H test for pixels 2 or 3 touching a black pixel in the direction away from pixels 1 and 4. Both side-to-side touches and corner-to-corner touches were considered. For example, in the configuration of FIG. 7, pixels B, C and D touched pixel 2 in the direction away from pixels I and 4 and pixels A, B and C touched pixel 3 in the direction away from pixel 4. If any of A, B, C or D were black, then an incorrect touch existed.

If only one of pixels 2 or 3 touched a black pixel, that pixel was marked for deletion and the other was left. Thus in FIG. 7 if only A was black, then 3 was marked for deletion and 2 was left as is. If only D was black then 2 was marked and 3 was left.

If both 2 and 3 touched one or more black pixels, then one was deleted and the other was either deleted or moved. "Moving" a pixel means turning off the current pixel and turning on an adjacent one.

If 2 was side-to-side with 4, then 2 was marked for deletion and 3 was considered for moving beside 4. (See FIGS. 7, 2B, 2E, 2I, 2L)

If 3 was side-to-side with 1, then 3 was marked for deletion and 2 was considered for moving beside 1. See FIGS. 2C, 2F, 2H, 2K.

If 2 was side-to-side with 1 and 3 was side-to-side with 4, then both were marked for deletion. See FIGS. 2A, 2D, 2G, 2J.

In the case of a three-pixel pattern where the end pixel is side-to-side with the start pixel (i.e., pixels 1 and 3 in FIGS. 4A–4H test for pixel 2 touching a black pixel in the direction away from pixels 1 and 3. For example, in the configuration of FIG. 8, if any of A, B or C are black, then an incorrect touch exists and pixel 2 is marked for deletion.

The same test is made in the case of a three-pixel pattern that ends at the same pixel as it starts if the pattern is horizontal or vertical rather than diagonal. (FIG. 5A–5D) For a diagonal three-pixel pattern that starts and ends at the same pixel, the match process looks in both the X and the Y directions for possible conflicts. (FIGS. 5E–5H) In FIG. 9A, if any of A, B, C, D, or E are black then consider moving 2 beside the start pixel in the direction away from the conflict. If only A is black, then there are two choices to be considered for moving 2, horizontally towards C or vertically towards E.

Figure 9A:
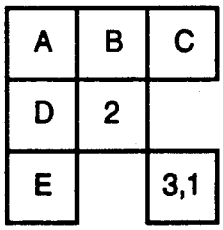
Figure 9B:
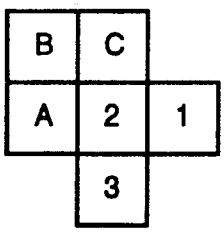

For a three-pixel pattern where the end pixel is corner-to-corner with the start pixel (FIGS. 6A–6D), if any of the three pixels away from 1 and 3 touching 2 is black, then mark 2 for deletion. In FIG. 9B if any of A, B, or C are black, then 2 will be marked for deletion.

Choice of Move versus Delete

If the match method calls for moving one pixel beside another pixel, then the pixel at the destination of the move and the three pixels touching the destination pixel on the side away from the neighbor pixel must be white. If they are not, then mark the pixel under consideration for deletion instead of for moving. In the example of FIG. 10, if A is a candidate for moving to location C beside B and if any of C, D, E, or F are black, then A will be marked for deletion instead of for moving to C.

Editing

The edits do not need to be done during the matching, but are preferably delayed until all the matching is completed. This ensures that the set of edits doesn't depend on the arbitrary choice of where to start the matching process, and also allows the edits to be prioritized and made conditional on the effects of previous editing operations.

The priority for edits is (1) moves first, (2) then deletes for non-corner points, and finally (3) deletes for corners. Corner points are three pixel patterns in which the end pixel is in corner-to-corner contact with start pixel (FIG. 6). For steps (2) and (3) the deletes are ordered according to the position in character space of the pixel to be deleted; pixels with larger Y coordinates go first, and in case of the same Y, pixels with larger X coordinates go first. One skilled in the art will recognize that other priority schemes will work equally well.

Figure 1A:
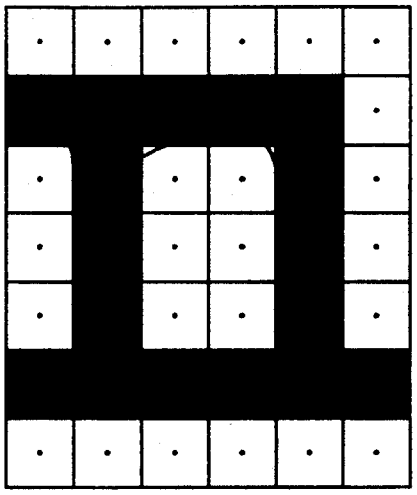
FIGS. 1A–1F illustrates pixel mapping of characters using a simple or modified center point fill method without using (1A, 1B, 1C) and using (1D, 1E, 1F) the method of the present invention.
Figure 1D:
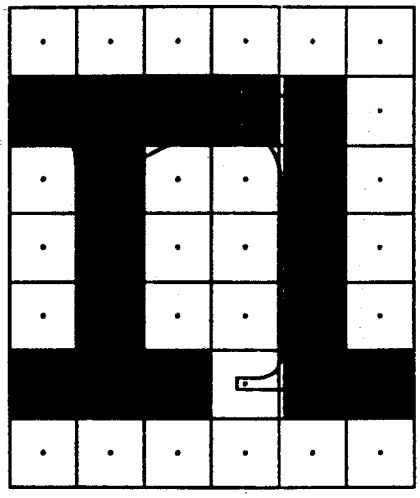
Figure 1B:
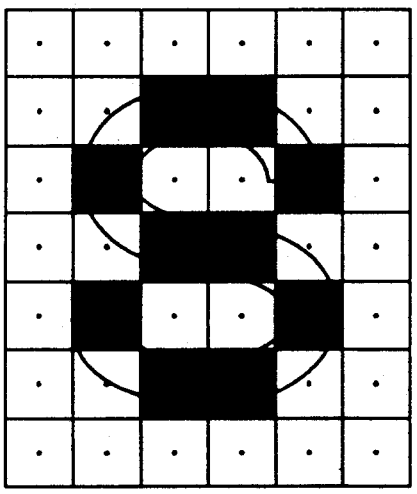
Figure 1E:
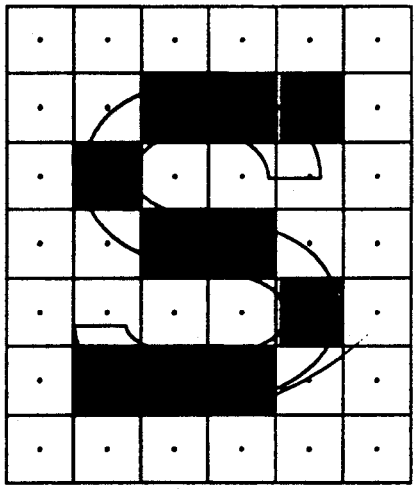
Figure 1C:
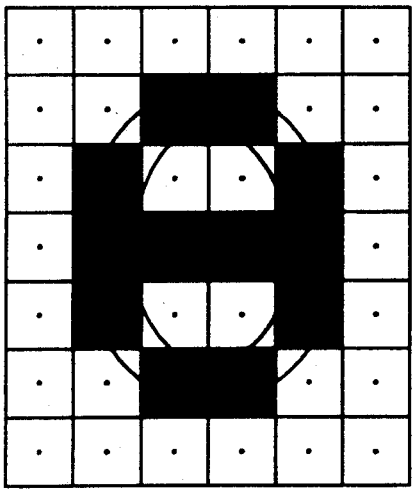
Figure 1F:
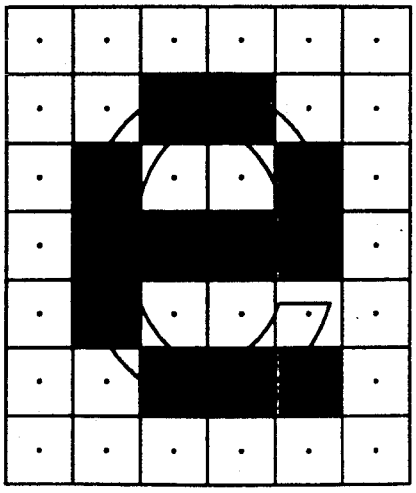

The ordering is important because a deletion is cancelled if previous edits have removed the conflict so that the deletion is no longer needed. For example, in the character "n" of FIGS. 1A and 1D, deletions would have been recorded for both inner serifs, but only the right serif was deleted because this deletion alone was enough to remove the conflict.

When recording a potential deletion, save both the coordinates of the pixel to be deleted and a vector pointing in the direction of the conflict. Then at the time the deletion becomes the highest priority edit, check using the vector to see if any adjacent pixel in the conflict direction is still set black. If so, go ahead with the delete. If not, the deletion is no longer necessary, so skip it.

These examples illustrate only some methods of practicing the present invention. Numerous examples of each of the configurations illustrated above were tested and the method of this invention was used to give characters with improved legibility. One skilled in the art will recognize and be able to practice additional methods that fall within the teachings of this invention. The enumeration and matching steps, for instance, can be performed as part of a single process. The matching step can be combined with the editing step. One skilled in the art may choose to enumerate less than the entire character outline, and might, for example, enumerate only those sections of the path which are near horizontal or vertical inflection points, near counter-clockwise inflections, or those sections which are known as likely to improperly close. One skilled in the art will recognize that other pixel patterns besides those in FIGS. 2A≧6D can be used to practice the method of this invention. The pattern in FIG. 11, for instance, can be used in practicing the teaching of this invention. One skilled in the art will also recognize that one or more sub-sets of the patterns described herein can be used, and that the priority for ordering pixel deletions and the criteria for choosing to move rather than delete the pixel can be modified. A choice of whether to move a pixel, for instance, can be made contingent on the effects of prior edits or that decision could be postponed until the rest of the character is edited to see if the move can be avoided. One skilled in the art will recognize that side-to-side and corner-to-corner touches may be acceptable in some circumstances and the method of invention can be practiced testing only for side-to-side touches plus corner-to-corner touches in no or under limited circumstances.

One skilled in the art will also recognize that the path of the character can be modified to minimize or delete instances of improper touching. One skilled in the art will recognize that it may be possible to perform some of the steps of this invention using the path itself rather than the pixels enumerated by the first step of this method. For example, one might test the path itself for counter-clockwise features, inflection points or proximity to other features of a character.

What is claimed is:

1. The method of displaying a high resolution character defined by an outline, using a pixel bitmap on a raster device at relatively low resolution, comprising:

selecting the pixels along said character outline having a midline which intersects said character outline;

grouping selected pixels into groups of two, three or four pixels including a point pixel representing a character point;

determining which of said groups include a point pixel which undesirably touches another part of said pixel bitmap;

moving or deleting one or more of said touching point pixels, and displaying the character at low resolution on said raster device, whereby the displayed character contains a discrete separation from said other part of said pixel bitmap at the former location of the moved or deleted point pixel.

2. The method of claim 1 wherein one of said groups of pixels includes three or four pixels, and wherein said outline intersects a midline of a first pixel of said group, then intersects a midline of a second pixel which is horizontally, vertically or diagonally adjacent to said first pixel, then intersects a midline of a third pixel which is horizontally, vertically or diagonally adjacent to said second pixel, and then intersects a midline of a fourth pixel which is either said first pixel or horizontally, vertically or diagonally adjacent to said third pixel and also horizontally or vertically adjacent to said first pixel.

3. The method of claim 1 wherein one of said groups of pixels includes two or three pixels and where said outline first intersects a midline of a first pixel of said group, then intersects a midline of a second pixel which is horizontally, vertically or diagonally adjacent to said first pixel, and then intersects a midline of a third pixel which is either said first pixel or horizontally, vertically or diagonally adjacent to said second pixel and also horizontally, vertically or diagonally adjacent to said first pixel.

4. The method of claim 1 wherein one of said groups of pixels include a start and an end pixel, wherein the undesirably touching point pixel of that group is moved horizontally or vertically so that it still touches the start or end pixel of that group and, after being moved, no longer touches any other portion of the character bitmap, or if such pixel cannot be so moved without distorting the character, said point pixel is deleted.

5. A method of claim 1 wherein one of said groups of pixels includes a start and an end pixel, and wherein the entire character bitmap is analyzed before any pixels are moved or deleted, further characterized by, beginning at a selected point along said character outline, for point pixels which undesirably touch other pixels of said pixel bitmap, to the extent possible without distorting said character, moving such point pixels horizontally or vertically so that they are still in contact with said start or end pixel or said group but do not touch said other pixels of said pixel bitmap, for point pixels of said one of said groups which undesirably touch other pixels of said pixel bitmap but which cannot be moved without distorting the character, where said start and end pixels are either a single pixel or are horizontally or vertically adjacent, deleting said point pixels, and for any remaining point pixels of said one of said groups which undesirably touch other pixels of said pixel bitmap, where said group has three pixels including start and end pixels which are diagonally adjacent to each other, deleting said point pixels.

* * * * *

UNITED STATES PATENT AND TRADEMARK OFFICE

CERTIFICATE OF CORRECTION

PATENT NO. : 5,237,313

DATED : August 17, 1993

INVENTOR(S) : Paxton et al.

It is certified that error appears in the above-indentified patent and that said Letters Patent is hereby corrected as shown below:

| | | |
|---|---|---|
| Col. 04, line 63 | delete "l" | insert --1-- |
| Col. 05, line 18 | after "4A-4H" | insert --)-- |
| Col. 06, line 35 | delete "≥" | insert -- - -- [a dash] |

Signed and Sealed this

Thirty-first Day of May, 1994

Bruce Lehman

*Attest:*

BRUCE LEHMAN

*Attesting Officer*

*Commissioner of Patents and Trademarks*